US011608948B1

(12) United States Patent
Yang

(10) Patent No.: US 11,608,948 B1
(45) Date of Patent: Mar. 21, 2023

(54) LIGHT-AND-SHADOW TABLE LAMP STRUCTURE

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 17/458,594

(22) Filed: Aug. 27, 2021

(51) Int. Cl.

| | |
|---|---|
| ***F21S 6/00*** | (2006.01) |
| ***F21V 3/04*** | (2018.01) |
| ***F21V 5/04*** | (2006.01) |
| ***F21V 23/00*** | (2015.01) |
| ***F21V 1/10*** | (2006.01) |
| *F21W 121/00* | (2006.01) |

(52) U.S. Cl.
CPC ..... *F21S 6/002* (2013.01); *F21V 1/10* (2013.01); *F21V 3/049* (2013.01); *F21V 5/046* (2013.01); *F21V 23/004* (2013.01); *F21W 2121/008* (2013.01)

(58) Field of Classification Search
CPC ..... F21V 1/10
See application file for complete search history.

(56) References Cited

U.S. PATENT DOCUMENTS 5,442,524 A * 8/1995 Farmer ..... F21S 10/00 362/35
5,676,988 A * 10/1997 Coleman ..... A23G 3/545 426/134
6,183,115 B1 * 2/2001 Durando ..... F21V 5/04 362/351
6,729,747 B1 * 5/2004 Wirayani ..... F21V 1/12 362/355
7,473,002 B1 * 1/2009 Chen ..... F21S 10/00 362/283
9,267,660 B1 * 2/2016 Wang ..... F21V 3/02
2007/0165195 A1 * 7/2007 Lockett ..... G09F 1/06 353/120
2014/0198949 A1 * 7/2014 Garlington ..... G09F 27/005 382/103
2015/0366020 A1 * 12/2015 Park ..... H05B 47/12 362/234
2016/0320014 A1 * 11/2016 Lin ..... F21V 15/00

* cited by examiner

*Primary Examiner* — Zheng Song
(74) *Attorney, Agent, or Firm* — Leong C. Lei

(57) ABSTRACT

A light-and-shadow table lamp structure includes a lamp base, a shadow projecting plate, and a lampshade. The lamp base includes at least one light-emitting element arranged on a top thereof. The shadow projecting plate is arranged above the at least one light-emitting element to correspond thereto. The shadow projecting plate is provided with a light-transmitting pattern. The lampshade is arranged on the top of the lamp base and circumferentially encloses a periphery of the at least one light-emitting element. The light-transmitting pattern is arranged to project, by means of light from the at least one light-emitting element, a shadow of the light-transmitting pattern onto an external object.

8 Claims, 8 Drawing Sheets

LIGHT-AND-SHADOW TABLE LAMP STRUCTURE

TECHNICAL FIELD OF THE INVENTION

The present invention relates to table lamps, and more particularly to a table lamp structure that exhibits an effect of light and shadow.

DESCRIPTION OF THE PRIOR ART

In the large indoor environment of a household, lighting is largely relying on lighting fixture mounted to the ceiling. Other corners of the house are often arranged with decorating lights and desk lamps, generally for decoration purposes. Such decoration lighting provides, in addition to illumination, an effect of enhancing the atmosphere of the environment.

An example is disclosed in U.S. Pat. No. 9,222,663 B1 owned by the present applicant, in which a light-transmitting three-dimensionally shaped decoration is additionally attached to a top of a water lamp, and a light-emitting element is provided in the interior thereof, so that upon energization, in addition to flowing of a low boiling point liquid contained in a main body of the water lamp and lighting emitting from a base, the light source inside the top-side shaped decoration is also projected outward to create a glaring visual effect. However, such a decoration luminary structure is functionally limited to variation of lighting on the outside of the main body of the water globe.

Commonly known table lamps or floor lamps are generally designed to provide the sole function of light projection, and are not intended for providing a visual effect to create or enhance the surrounding environment. Other art lamps that are advantageous in light of unique shapes may have an effect of beautifying an indoor environment, yet it is generally not available for such lamps to feature a unique art shape, while at the same time enable variation of lighting shadows. Thus, a table lamp would be more eye-catching for the general public if, in addition to having features in both decoration and lighting, such a lamp is provided with advantages of playfulness exhibited in other parts or a breakthrough to outside visual perception.

SUMMARY OF THE INVENTION

In view of the above, the primary objective of the present invention is to provide a light-and-shadow table lamp structure, which comprises:

a lamp base, which has an interior space in which an electrical control unit is arranged, the electrical control unit comprising at least one light-emitting element arranged at a top of the lamp base;

a shadow projecting plate, which is arranged above the at least one light-emitting element to correspond thereto, the shadow projecting plate comprising a light-transmitting pattern; and a lampshade, which is arranged on the top of the lamp base and surrounds and circumferentially encloses the shadow projecting plate and the at least one light-emitting element.

Light from the at least one light-emitting element projects outward to cast a shadow of the light-transmitting pattern of the shadow projecting plate onto an external object so as to achieve an effect of varying light projection to form a light shadow at the outside.

DETAILED DESCRIPTION OF THE PREFERRED EMBODIMENT

Figure 1:
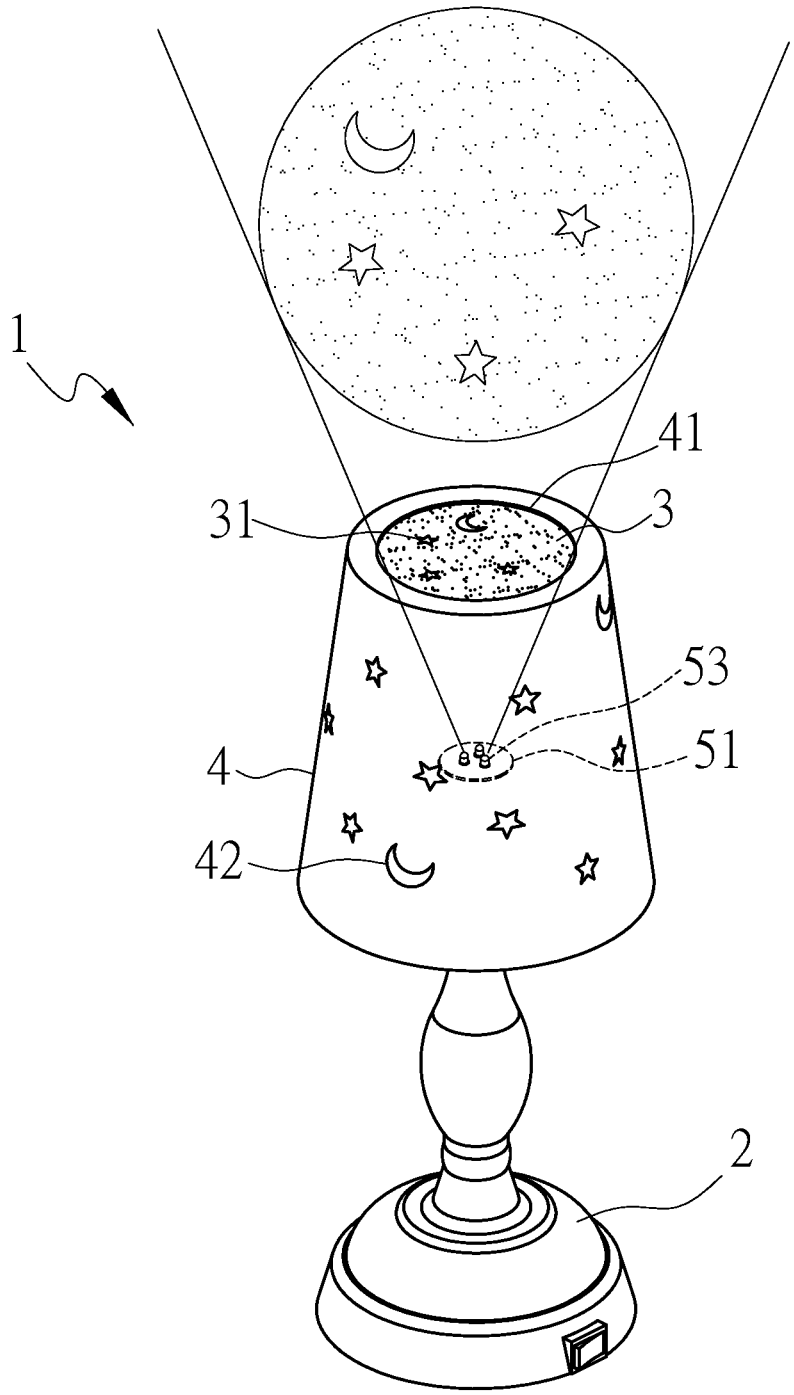
FIG. 1 is a perspective view of the present invention, illustrating a condition of projecting light or casting a shadow.
Figure 2:
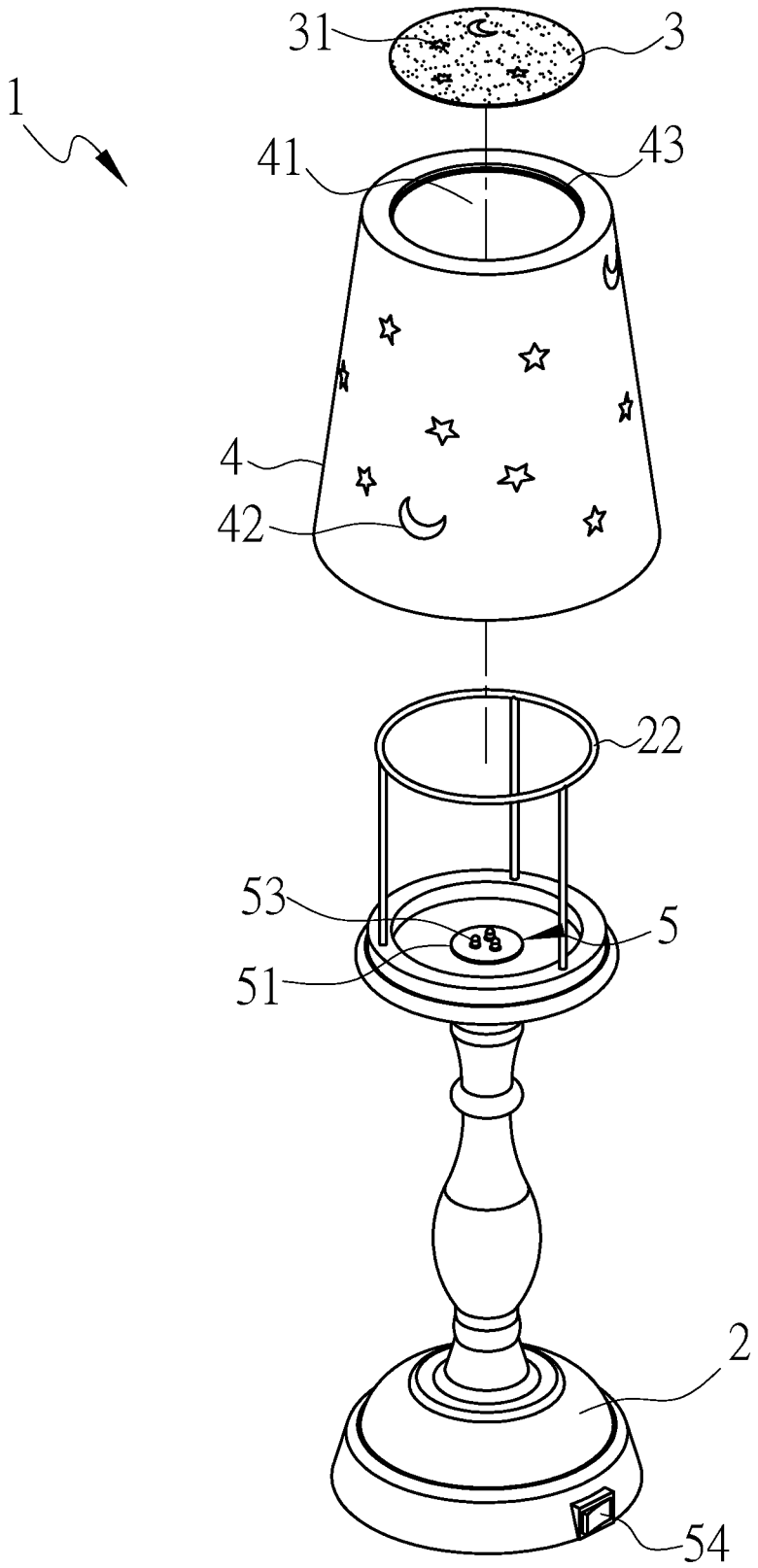
FIG. 2 is an exploded view of the present invention.
Figure 3:
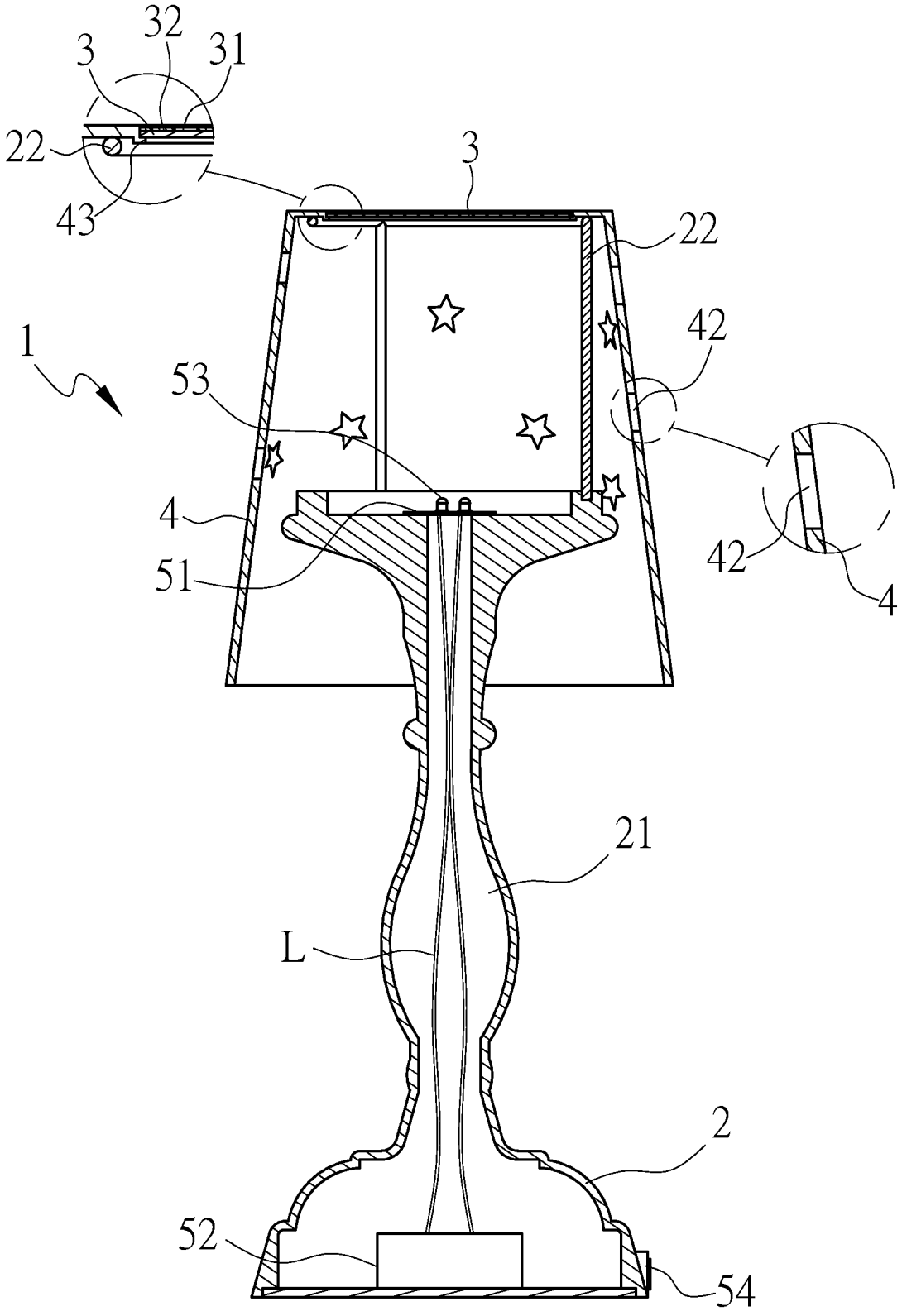
FIG. 3 is a cross-sectional view of the present invention, as well as enlarged views of portions thereof.
Figure 4:
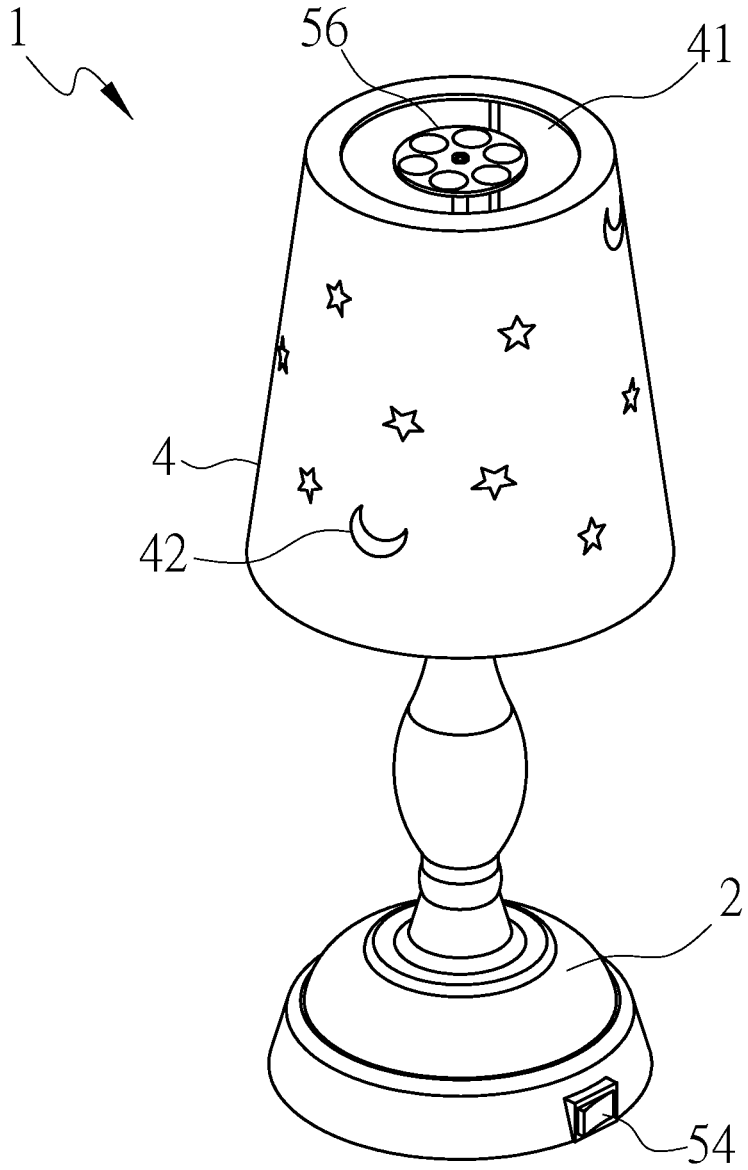
FIG. 4 is a perspective view showing a second embodiment of the present invention.
Figure 5:
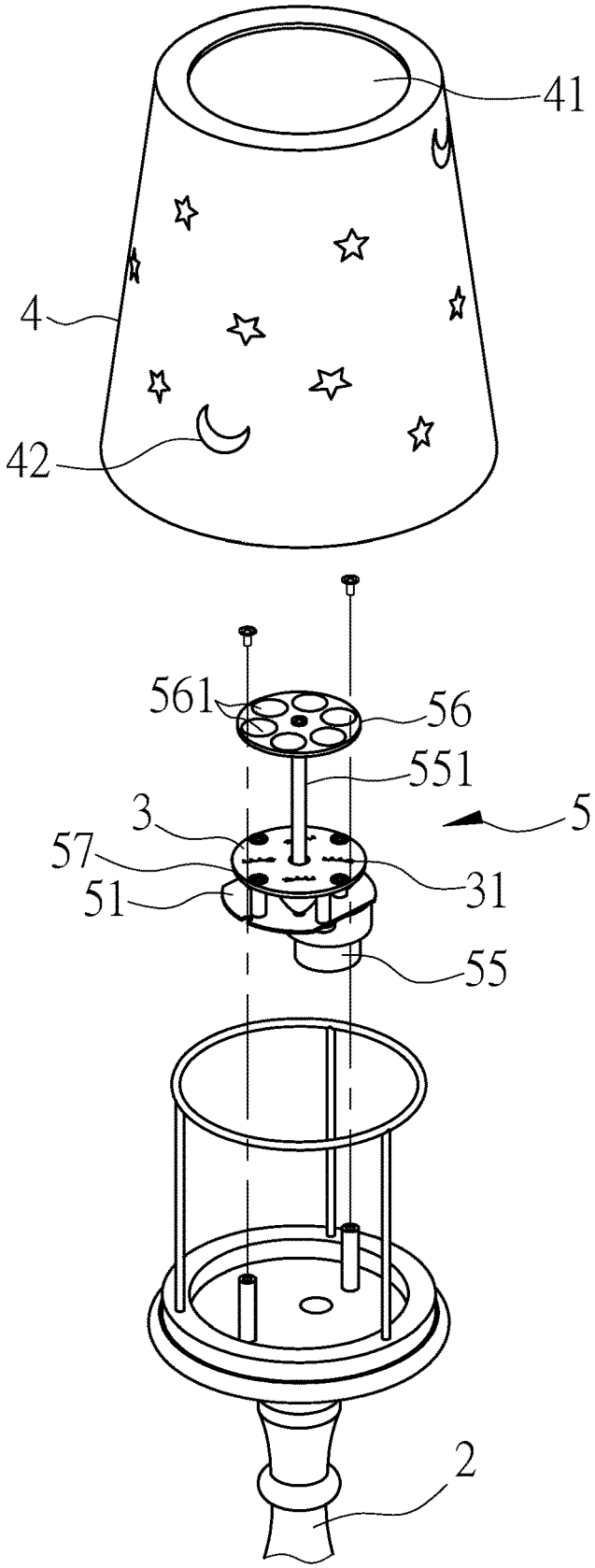
FIG. 5 is an exploded view of FIG. 4.
Figure 6:
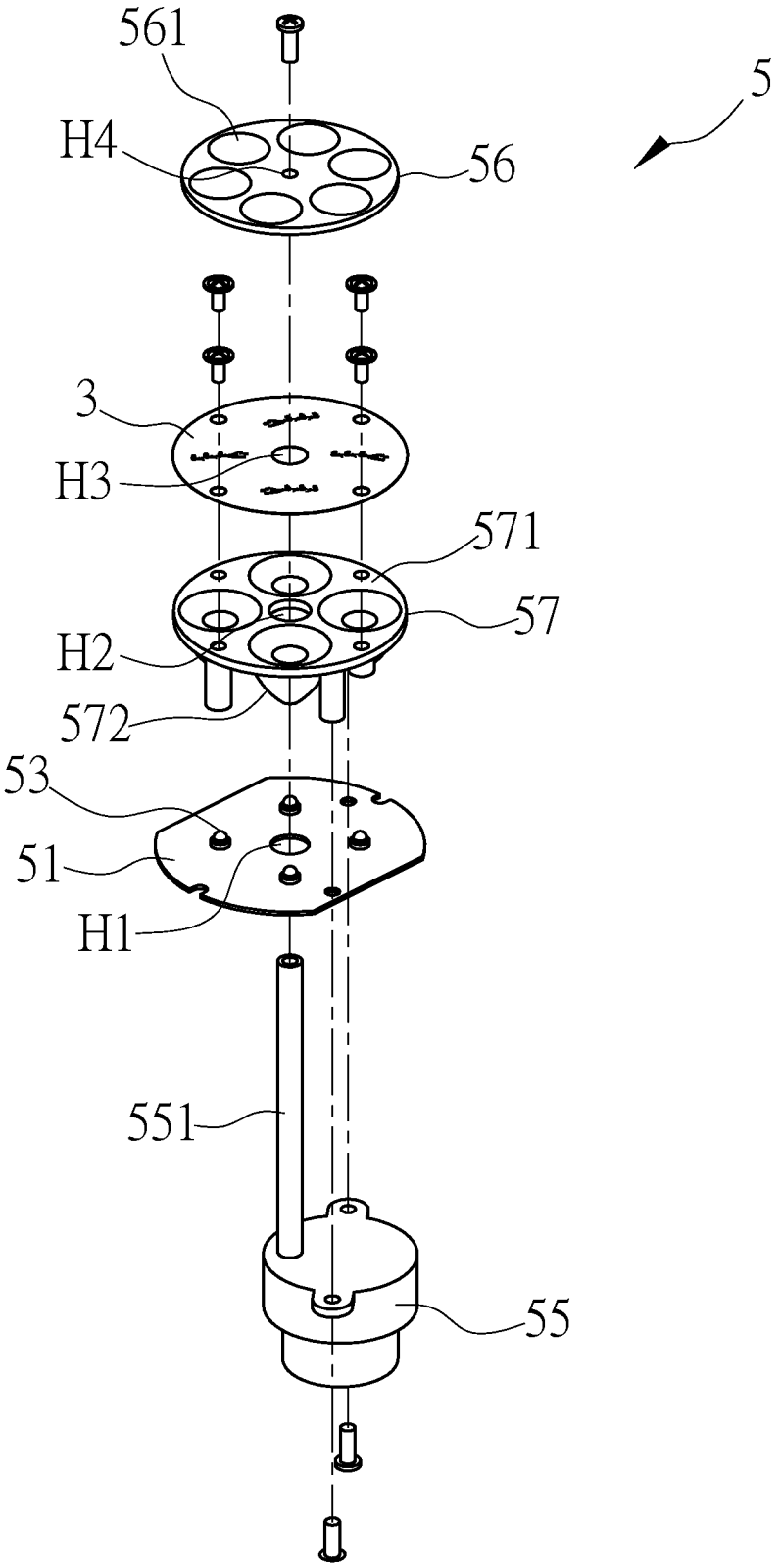
FIG. 6 is an exploded view showing an electrical control unit shown in FIG. 5.
Figure 7:
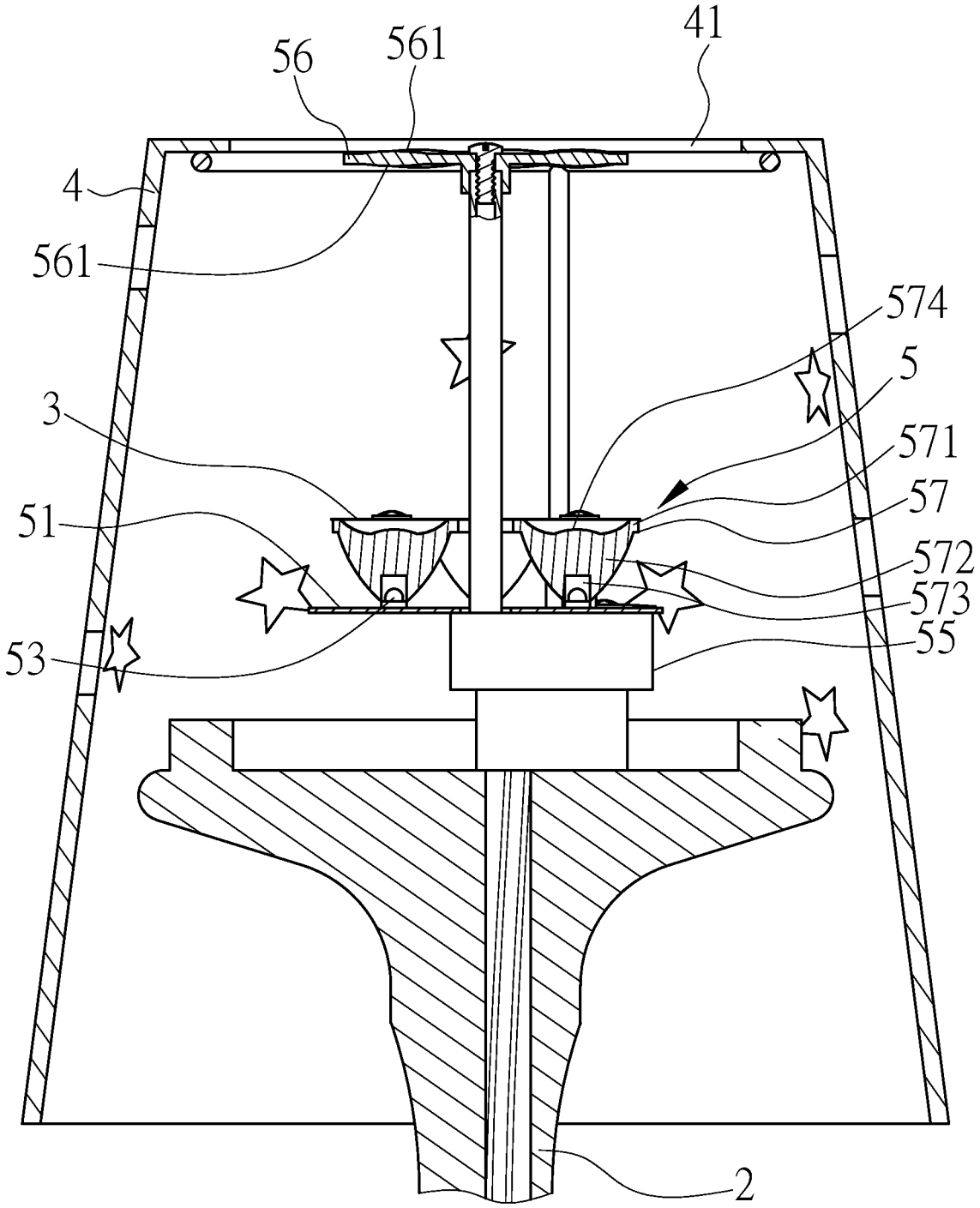
FIG. 7 is a cross-sectional view of a portion of FIG. 4.

Referring to FIGS. 1-3, the present invention provides, in a preferred embodiment, a structure of a light-and-shadow table lamp (1), which generally comprises: a lamp base (2), a shadow projecting plate (3), and a lampshade (4). The present invention does not constrain the material of the lamp base, which can be, for example, wood, plastics, and metals.

The lamp base (2) is of an inverted T-shaped structure includes a bottom part and a supporting post fixed to the bottom part and extending upward therefrom. The lamp base (2) has an interior space in which an electrical control unit (5) is arranged. The electrical control unit (5) comprises a circuit board (51), a power supply portion (52), a plurality of light-emitting elements (53), and a switch (54). The power supply portion (52), each of the light-emitting elements (53), and the switch (54) are in electrical connection with the circuit board (51). The present invention imposes no constraint to the quantity of the light-emitting elements (53) except that the number has to be at least one; an example provided in the drawings shows multiple light-emitting elements for illustration, but not limitative, purposes. Each of the light-emitting elements (53) can be an LED light or a tungsten filament light bulb. The present invention does not limit the type of the power supply portion (52), which can be electric main or a battery. In the instant embodiment, the power supply portion (52) is disposed in the bottom of the lamp base (2), while the circuit board (51) is arranged at a top of the lamp base (2). The lamp base (2) is provided with a channel (21) extending in an axial direction in order to accommodate electrical wires (L). Each of the light-emitting elements (53) is arranged to irradiate toward a top side. The lamp base (2) is further provided, on the top thereof, with a fixing frame (22). The fixing frame (22) functions to support the lampshade (4), and thus, a top of the fixing frame (22) is set spacing from the top of the lamp base (2) by a predetermined distance.

The shadow projecting plate (3) is arranged to correspond to the light-emitting elements (53) at a location above the light-emitting element. The shadow projecting plate (3) comprises a light-transmitting pattern (31), and a moon-and-star pattern is taken as an example for illustration in the instant embodiment, but the present invention is not limited thereto. If desired, a user may change the light-transmitting pattern (31) to different patterns including flowers, landscape, and texts.

The lampshade (4) is positioned on and mounted to the top of the fixing frame (22) of the lamp base (2) and circumferentially encloses a periphery of the shadow projecting plate (3) and the light-emitting elements (53). The lampshade (4) is formed with a projection hole (41) corresponding to the shadow projecting plate (3). The lampshade (41) may be further formed with a light-penetrating pattern (42), and in the instant embodiment, the light-penetrating pattern (42) is also a moon-and-star pattern to match up with the light-transmitting pattern (31), but not limited thereto. The shadow projecting plate (3) can be integrally formed with the top end of the lampshade (4), or may alternatively be implemented in the way shown in the drawings of the instant embodiment, where the top of the lampshade (4) is formed with the projection hole (41), and the top of the lampshade (4) is provided with a receiving or receptacle portion (43) for receiving and retaining the shadow projecting plate (3) therein. The receiving or receptacle portion (43) is in communication with the projection hole (41) to allow the shadow projecting plate (3) to be positioned and mounted in the receiving or receptacle portion (43) in a removable manner.

Following the above, the present invention does not put constraint on light-transmitting pattern (31) and the light-penetrating pattern (42) in respect of shape, structure, and outside appearance thereof, and in an example, as shown in the enlarged view of a portion of the lampshade (4) provided in FIG. 3, the light-penetrating pattern (42) includes a penetrating hole penetrating through the thickness of the lampshade (4), or in an alternative or additional example, as shown in the enlarged view of a portion of the shadow projecting plate (3) provided in FIG. 3, the shadow projecting plate (3) is of a transparent material, and is thus light transmittable, and a light un-transmittable or opaque covering layer (32) arranged on an inside surface or an outside surface thereof, for example the covering layer being formed by coating a colorant or electroplating, and a predetermined portion of the covering layer (32) is removed by means of a known technique, such as applying laser engraving to remove the predetermined portion to form a hollowed portion, such that the hollowed portion of the covering layer (32) forms the light-transmitting pattern (31).

As such, light from each of the light-emitting elements (53) may transmit through the light-transmitting pattern (31) of the shadow projecting plate (3) to project through the projection hole (41) to an outside object, such as a wall, a ceiling, and a piece of furniture. Further, light from each of the light-emitting elements (53) also penetrates through the light-penetrating pattern (42) of the lampshade (4), so that in addition to lighting, the table lamp (1) also provides a function of shadow casting through light projection. Further, the circuit board (51) is operable to control variation of light color for each of the light-emitting elements (53), so that the shadow casting through light projection may become dazzling or glaring. It is noted that if desired, the user may change or replace the shadow projecting plate (3) with a different pattern in order to change the environmental atmosphere with different visual perceptions.

Referring to FIGS. 4-8, a second embodiment according to the present invention is shown, and a description to similar parts will be omitted therein. In the instant embodiment, the electrical control unit (5) further comprises a motor (55), a rotatable plate (56), and a lamp cup (57). Special reference being had to FIGS. 5-7, the motor (55) is disposed under the circuit board (51). The circuit board (51) is provided thereon, in a sequence from a top side to a bottom side, with a lamp cup (57), the shadow projecting plate (3), and the rotatable plate (56). The circuit board (51) is formed, in a center thereof, with a first hole (H1) penetrating therethrough. The lamp cup (57) is formed with a second hole (H2). The shadow projecting plate (3) is formed with a third hole (H3). The rotatable plate (56) is formed with a fourth hole (H4). The second hole (H2), the third hole (H3), and the fourth hole (H4) are set coaxial with the first hole (H1). The motor (55) comprises a rotating axle (551), and the rotating axle (551) extends through the first hole (H1), the second hole (H2), and the third hole (H3) to have a top end of the rotating axle (551) abutting the rotatable plate (56), and a bolt is applied to fix the rotatable plate (56) to the top end of the rotating axle (551), such that the rotatable plate (56) is rotatable in unison with rotation of the rotating axle (551).

In the instant embodiment, the shadow projecting plate (3) is structured such that the light-transmitting pattern (31) includes four groups of festival or holiday symbols spaced from each other and is fixed by bolts or screws to the top side of the lamp cup (57). The rotatable plate (56) is structured such that a top surface and a bottom surface are provided with a plurality of first lenses (561) that are arranged at intervals and correspond to the light-transmitting pattern (31).

The lamp cup (57) is light transmittable and comprises a platform (571) and a plurality of cup bodies (572). Each of the cup bodies (572) is arranged on a bottom side of the platform (571) and is extended toward a respective one of the light-emitting elements (53), and is formed with an accommodation hole (573), such that each of the accommodation holes (573) receives the respective one the light-emitting elements (53) therein to have the light-emitting element housed therein. Mounted on a top side of the platform (571) to correspond each of the cup bodies (572) is a second lens (574), and each of the second lenses (574) faces the light-transmitting pattern (31) of the shadow projecting plate (3).

Figure 8:
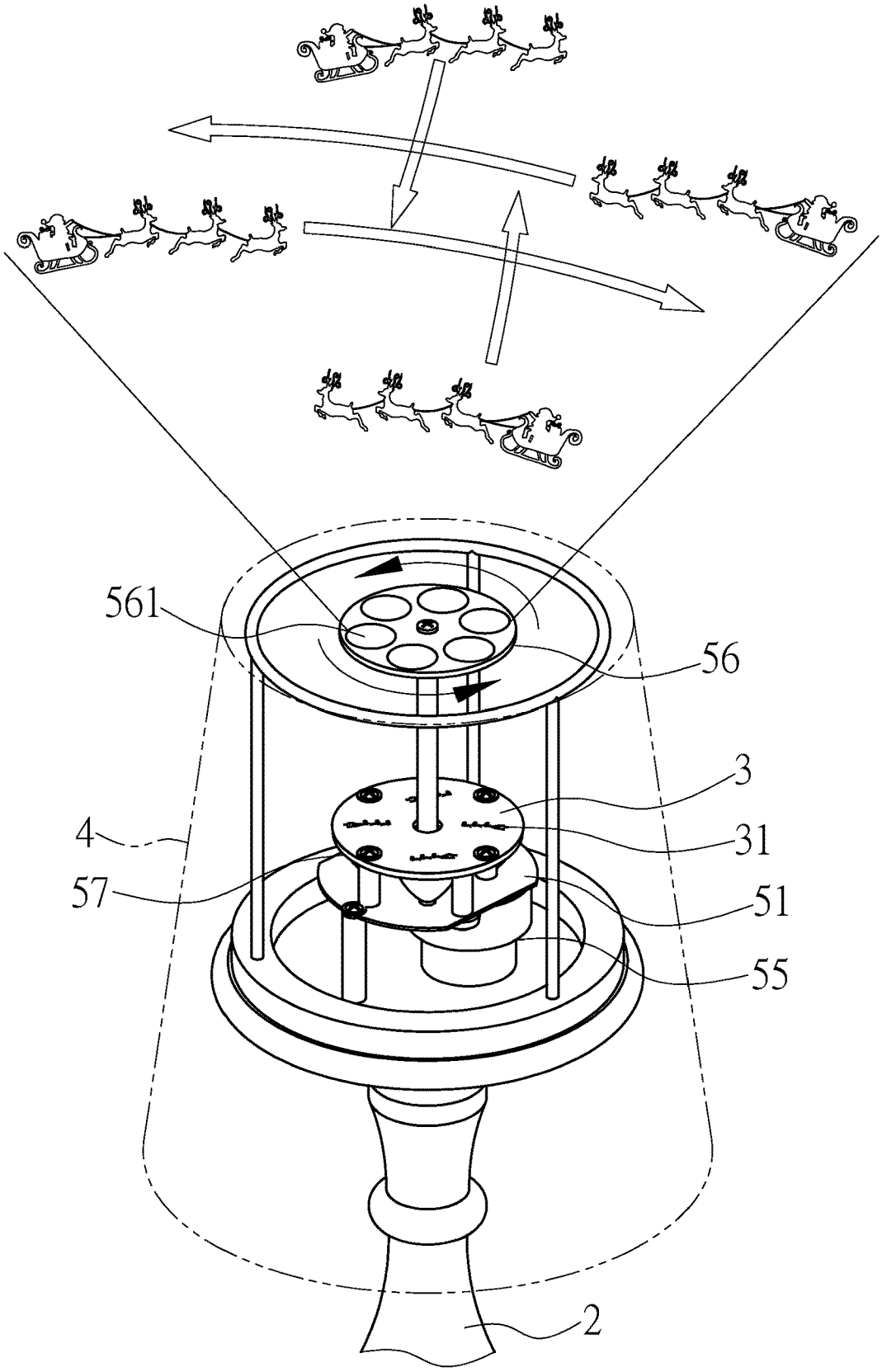
FIG. 8 is a perspective view, illustrating a condition of projecting light or casting a shadow for the second embodiment.

Referring to FIG. 8, when the table lamp (1) is supplied with electrical power, each of the light-emitting elements (53) emits light that transmits through a respective one of the first lenses (561) and a respective one of the second lenses (574) corresponding thereto to have the light shape varied by the lenses and is then projected by the light-transmitting pattern (31) of the shadow projecting plate (3) to pass through the projection hole (41) of the lampshade (4) to cast a shadow on an external object. With the rotatable plate (56) being rotated with the rotating axle (551), the light-transmitting pattern (31) generates a dynamic effect through position shifting and change of the light shape generated by the first lens (561). FIG. 8 includes arrows that indicate the directions of position shifting of the light-transmitting pattern (31). As such, in addition to a static function of lighting, the table lamp (1) also provides a dynamic effect of playful shadow casting through light projection.

I claim:

1. A light-and-shadow table lamp structure, comprising:

a lamp base, which has an interior space in which an electrical control unit is arranged, the electrical control unit comprising at least one light-emitting element arranged at a top of the lamp base;

a shadow projecting plate, which is arranged above the at least one light-emitting element to correspond thereto, the shadow projecting plate comprising a light-transmitting pattern; and a lampshade, which is arranged on the top of the lamp base and surrounds and circumferentially encloses the shadow projecting plate and the at least one light-emitting element;

wherein the electrical control unit further comprises a motor, a rotatable plate, and a lamp cup, the motor comprising a rotating axle, the rotatable plate being arranged above the shadow projecting plate and fixed to a top end of the rotating axle to rotate in unison with the rotating axle, the rotatable plate being provided with a plurality of first lenses that are arranged at intervals and corresponding to the light-transmitting pattern, the lamp cup being arranged between the at least one light-emitting element and the shadow projecting plate, the lamp cup comprising a platform and at least one cup body, the at least one cup body being provided at a bottom side of the platform and extended toward the at least one light-emitting element and comprising an accommodation hole to receive and thus house the at least one light-emitting element therein, the platform being provided, on a top side thereof, with a second lends corresponding to the at least one cup body, the second lens being arranged to face toward the light-transmitting patter of the shadow projecting plate.

2. The light-and-shadow table lamp structure according to claim 1, wherein the lampshade is formed with a projection hole corresponding to the shadow projecting plate.

3. The light-and-shadow table lamp structure according to claim 1, wherein the top end of the lampshade is formed with a receptacle portion for receiving and retaining the shadow projecting plate therein.

4. The light-and-shadow table lamp structure according to claim 1, wherein the light-transmitting pattern comprises a hole penetrating through a thickness of the shadow projecting plate.

5. The light-and-shadow table lamp structure according to claim 1, wherein the shadow projecting plate is light transmittable and has an inside surface or an outside surface on which a covering layer is provided, the covering layer having a hollowed portion that defines the light-transmitting pattern.

6. The light-and-shadow table lamp structure according to claim 1, wherein the electrical control unit further comprises a circuit board, a power supply portion, and a switch and is disposed in a bottom of the lamp base, the power supply portion and the switch being in electrical connection with the circuit board.

7. The light-and-shadow table lamp structure according to claim 1, wherein the lampshade is formed with a light-penetrating pattern.

8. The light-and-shadow table lamp structure according to claim 1, wherein a fixing frame is mounted to the top of the lamp base, and the lampshade is mounted on the fixing frame.

* * * * *